US007721458B2

(12) United States Patent
Liu

(10) Patent No.: US 7,721,458 B2
(45) Date of Patent: May 25, 2010

(54) LEVEL ADJUSTING DEVICE FOR A CUTTER HEAD OF A JOINTER/PLANER MACHINE

(75) Inventor: Chin-Yuan Liu, Taichung (TW)

(73) Assignee: Shinmax Industry Co., Ltd., Taichung Hsien (TW)

( * ) Notice: Subject to any disclaimer, the term of this patent is extended or adjusted under 35 U.S.C. 154(b) by 90 days.

(21) Appl. No.: 12/231,111

(22) Filed: Aug. 29, 2008

(65) Prior Publication Data

US 2009/0260245 A1 Oct. 22, 2009

(30) Foreign Application Priority Data

Apr. 18, 2008 (CN) ..... 2008 2 0111502 U

(51) Int. Cl.
*B27C 1/00* (2006.01)
*B27C 5/02* (2006.01)

(52) U.S. Cl. ..... 33/635; 33/633; 144/117.1

(58) Field of Classification Search ..... 33/628, 33/632, 633, 634, 640, 641; 144/114.4, 114.7, 144/253.5, 253.8
See application file for complete search history.

(56) References Cited

U.S. PATENT DOCUMENTS 5,675,903 A * 10/1997 Cole ..... 33/635
5,988,239 A * 11/1999 Chen ..... 144/129
6,305,447 B1 * 10/2001 Rousseau ..... 144/135.2
7,503,357 B2 * 3/2009 Chuang ..... 144/114.1
7,624,775 B2 * 12/2009 Smith et al. ..... 144/114.1

* cited by examiner

*Primary Examiner*—R. Alexander Smith
(74) *Attorney, Agent, or Firm*—Ohlandt, Greeley, Ruggiero & Perle, L.L.P.

(57) ABSTRACT

A level adjusting device for a cutter head of a jointer/planer machine, includes a front support frame for supporting a front anti-friction bearing unit that holds a front journal segment of the cutter head, a rear support frame including left and right base abutments, a height-adjustable carrier for receiving a rear anti-friction bearing member that holds a rear journal segment of the cutter head, left and right lugs respectively having inner tubular threaded surfaces, and left and right adjusting screws respectively having threaded segments which are threadedly and respectively engaged with the inner tubular threaded surfaces, and abutting ends which are in frictional engagement with the base abutments, respectively, and which are turnable to move the respective lugs relative to the adjusting screws so as to raise or lower the carrier, thereby enabling level adjustment of the cutter head.

5 Claims, 9 Drawing Sheets

LEVEL ADJUSTING DEVICE FOR A CUTTER HEAD OF A JOINTER/PLANER MACHINE

CROSS-REFERENCE TO RELATED APPLICATION

This application claims priority of Chinese Patent Application No. 200820111502.1, filed on Apr. 18, 2008.

BACKGROUND OF THE INVENTION

1. Field of the Invention

This invention relates to a cutter head of a jointer/planer machine, more particularly to a level adjusting device for a cutter head of a jointer/planer machine.

2. Description of the Related Art

Referring to FIGS. 1 to 3, a conventional jointer/planer machine 10 is shown to include a machine frame 11, a base 12 secured on the machine frame 11, infeed and outfeed tables 13 mounted at two opposite sides of the base 12, a cutter head 14 mounted between the infeed and outfeed tables 13, front and rear anti-friction bearing members 15,17 journaling front and rear ends of the cutter head 14, a height-adjusting carrier unit 16, and a set screw 171 securing the front anti-friction bearing member 15 to a front seat wall 121 of the base 12 through a housing 151.

The base 12 has a mounting recess 122 for receiving the carrier unit 16. The carrier unit 16 has a carrier 161 for mounting the rear anti-friction bearing member 17, and two lugs 162 which are secured to the base 12 by means of two tightening screws 18 that are inserted into the lugs 162 and that are threadedly engaged with screw holes 124 in the base 12. An adjusting screw 19 is threadedly engaged with a tightening hole 123 to permit the carrier unit 16 to rest thereon.

Referring to FIGS. 4 and 5, when it is desired to adjust the level of the cutter head 14, the tightening screws 18 are required to be loosened, and the adjusting screw 19 is turned to a desired height position. Subsequently, the carrier unit 16 is rested on the adjusting screw 19. Finally, the tightening screws 18 are turned to tighten the carrier unit 16, thereby completing the adjusting operation.

The tightening screws 18 must be turned repeatedly to loosen and tighten the carrier unit 16 during the adjusting operation, which renders the operation inconvenient. Moreover, the adjusting screw 19 must be turned to the desired level using a gauge, and cannot bring the carrier unit 16 to move synchronously therewith.

SUMMARY OF THE INVENTION

An object of the present invention is to provide a level adjusting device for a cutter head of a jointer/planer machine, which can simplify the adjusting operation to permit a convenient and precise level adjustment.

According to this invention, the level adjusting device includes a front support frame having a front seat wall for supporting a front anti-friction bearing unit that holds a front journal segment of a cutter head, and a rear support frame spaced apart from the front support frame. The rear support frame includes left and right base abutments facing upwardly. A height-adjustable carrier has an insertion bore for receiving a rear anti-friction bearing member that holds a rear journal segment of the cutter head. Left and right lugs are disposed outboard of the height-adjustable carrier, and respectively have inner tubular threaded surfaces. Left and right adjusting screws respectively have threaded segments that are engaged threadedly and respectively with the inner tubular threaded surfaces of the lugs, and abutting ends configured to be in frictional engagement with the base abutments, respectively. The abutting end of each adjusting screw is turnable about a revolving axis in the upright direction such that the respective lug is moved relative to the adjusting screw so as to raise or lower the carrier, thereby enabling level adjustment of the cutter head.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
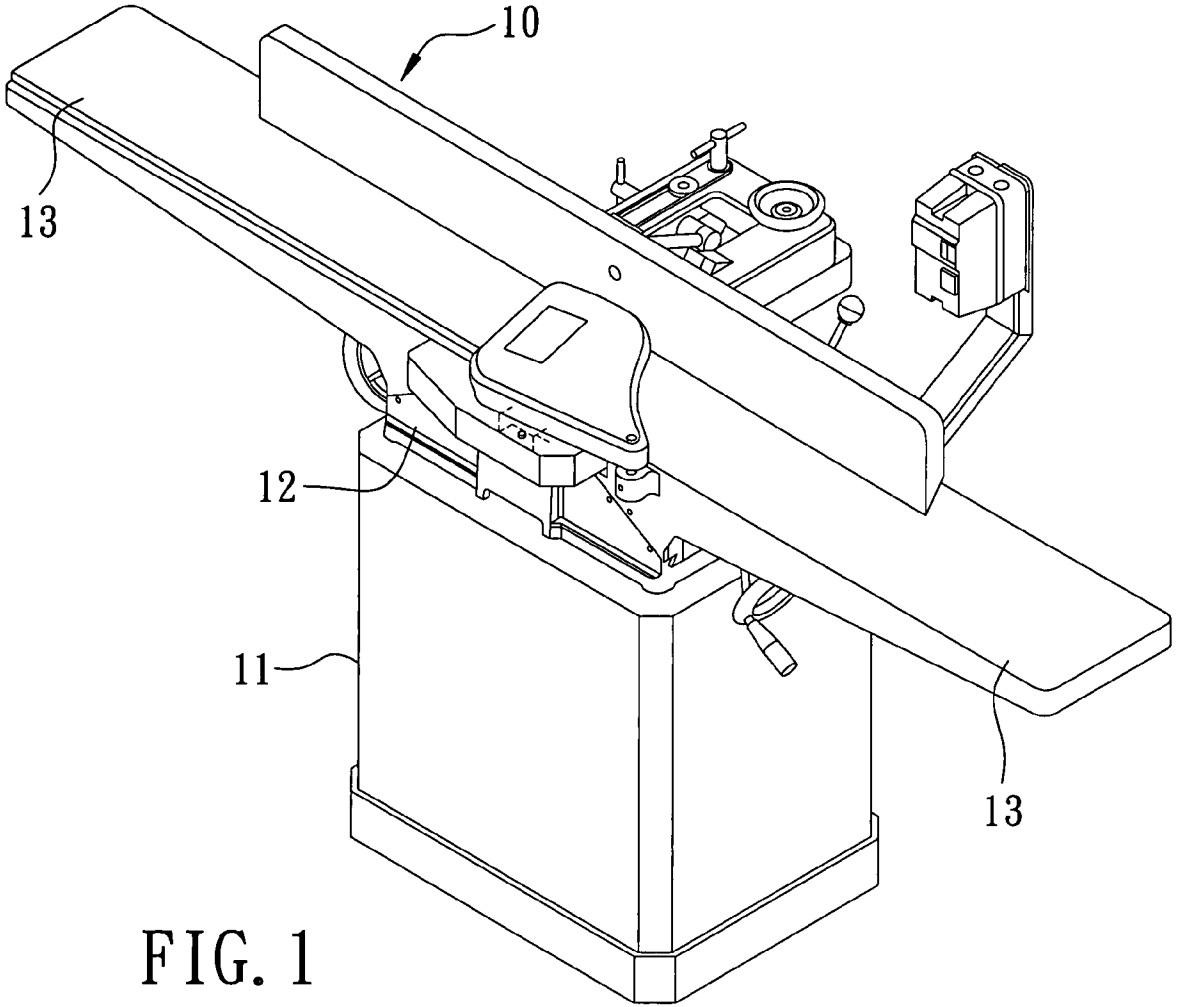
FIG. 1 PRIOR ART
FIG. 1 is a perspective view of a conventional hand-feed jointer/planer machine.
Figure 2:
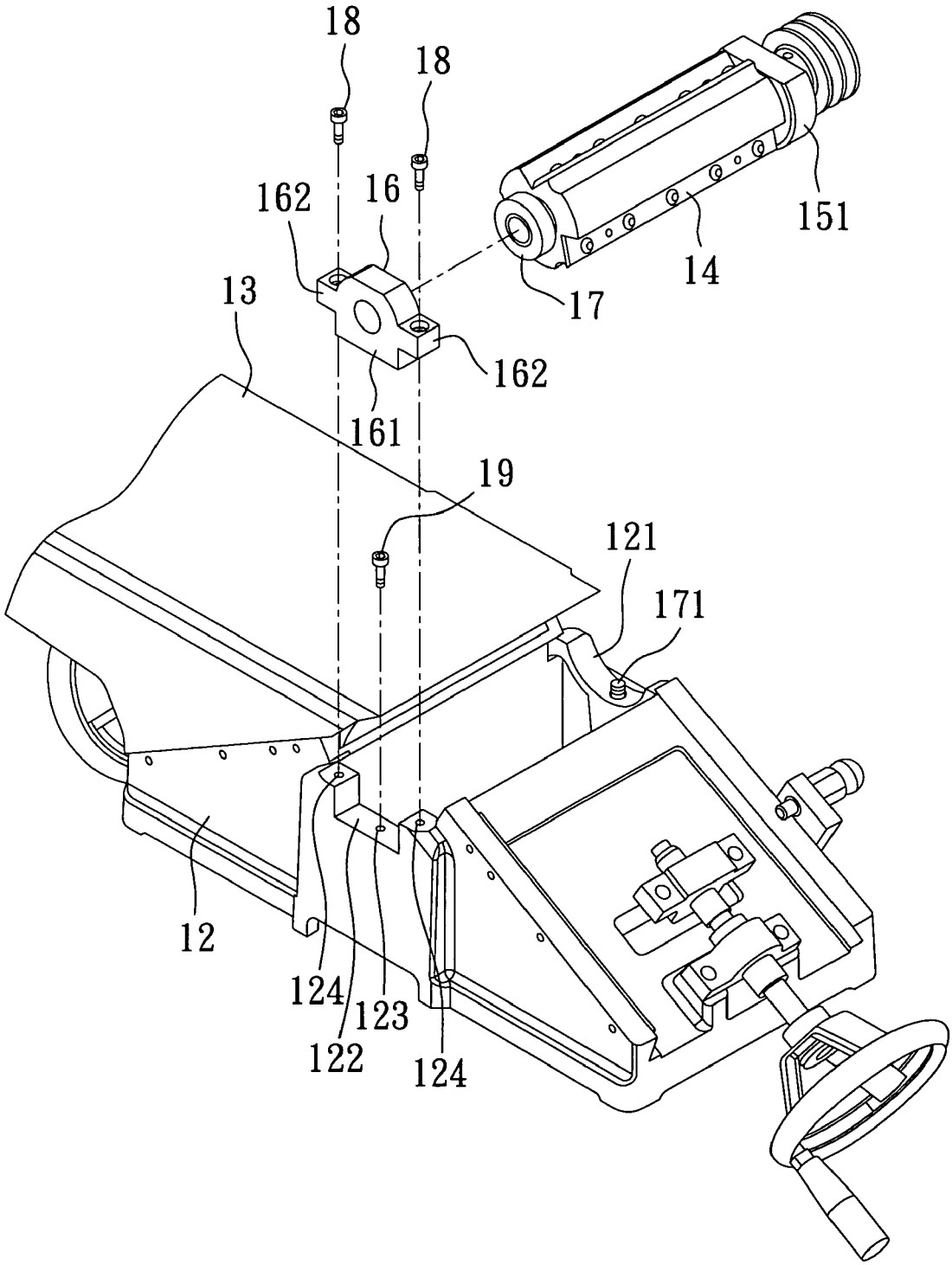
FIG. 2 PRIOR ART
FIG. 2 is a fragmentary exploded perspective view of the conventional hand-feed jointer/planer machine.
Figure 3:
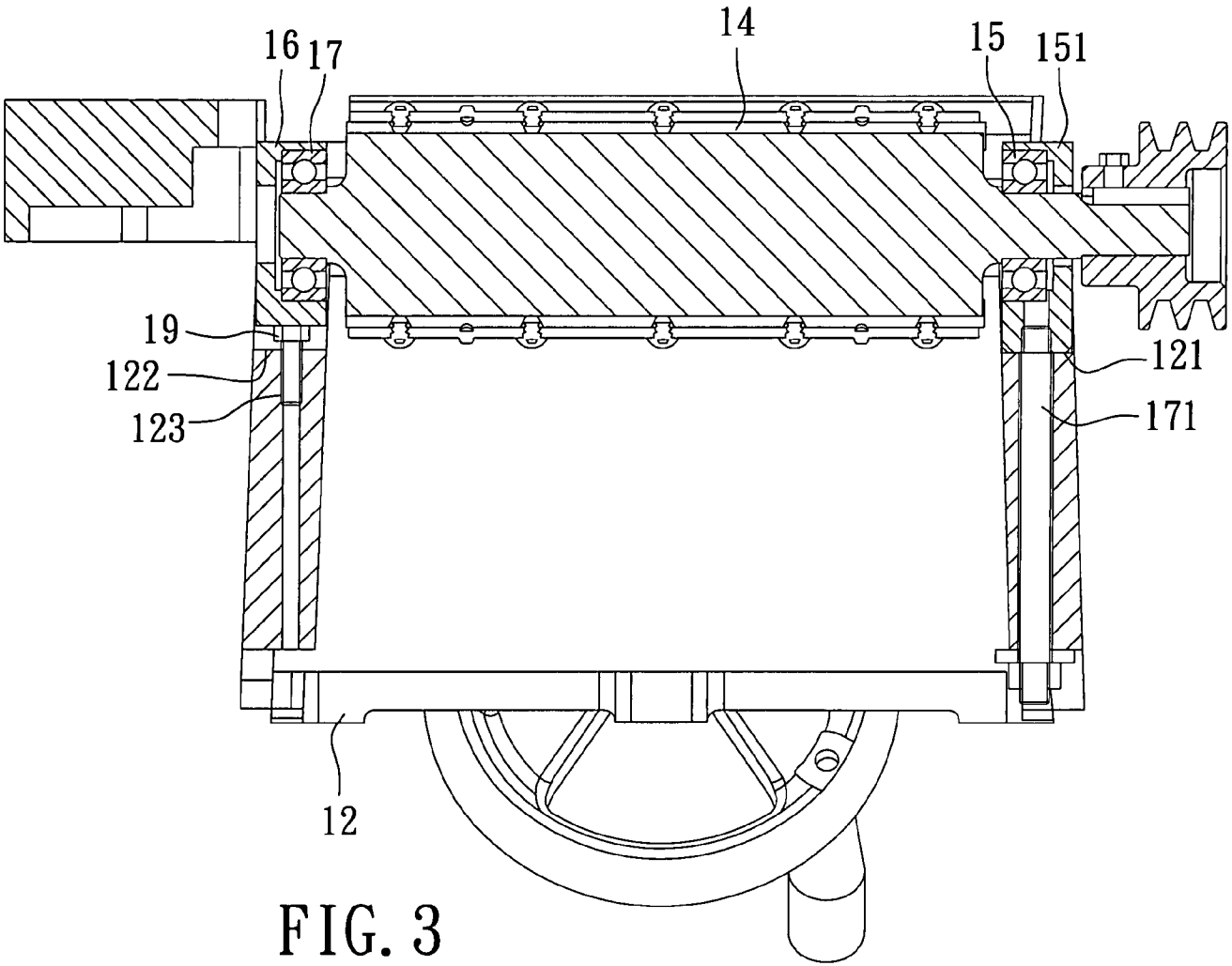
FIG. 3 PRIOR ART
FIG. 3 is a partly sectional view of the conventional hand-feed jointer/planer machine.
Figure 4:
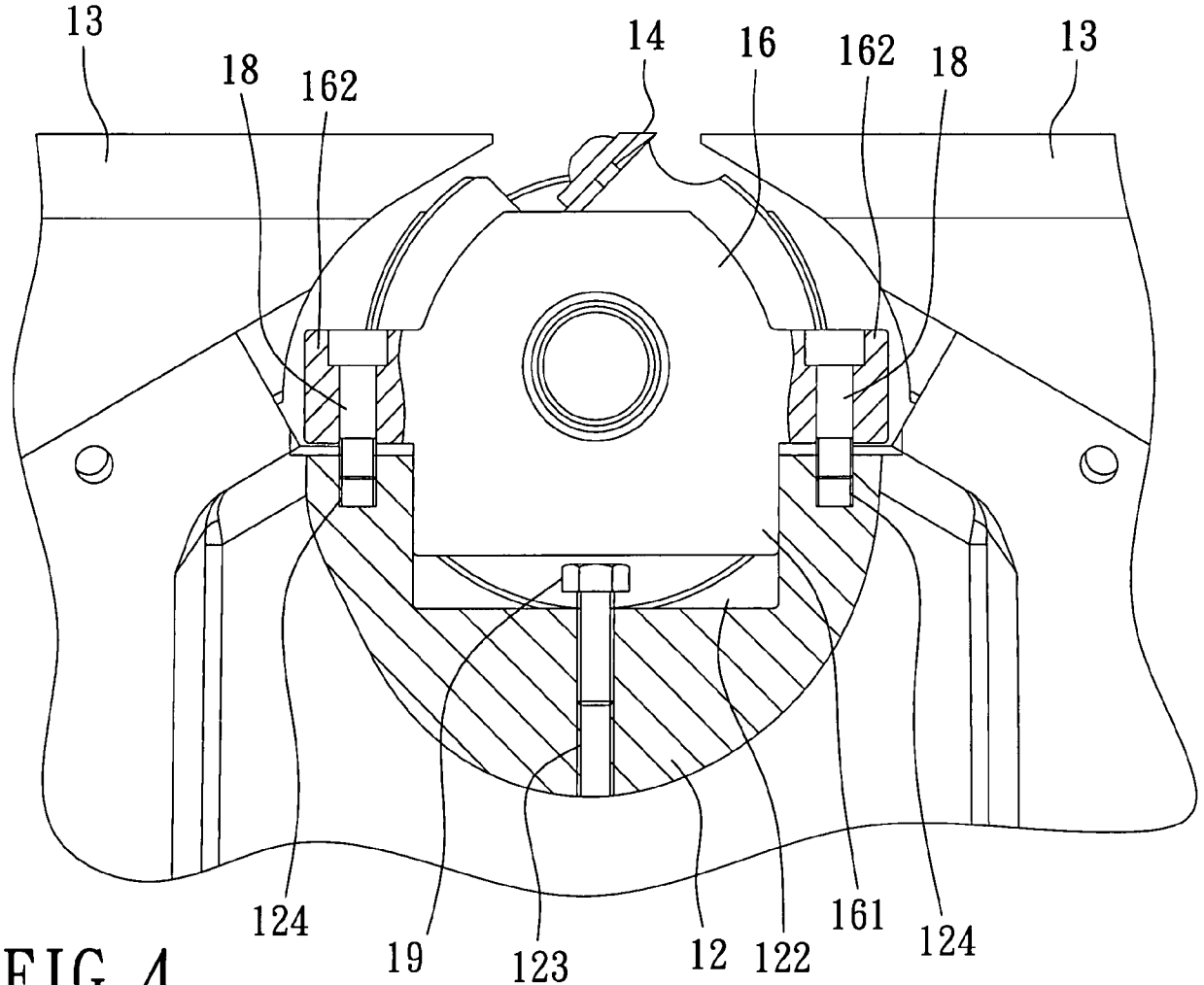
FIG. 4 PRIOR ART
FIG. 4 is a fragmentary and partly sectional view of the conventional hand-feed jointer/planer machine during a level adjusting process.
Figure 5:
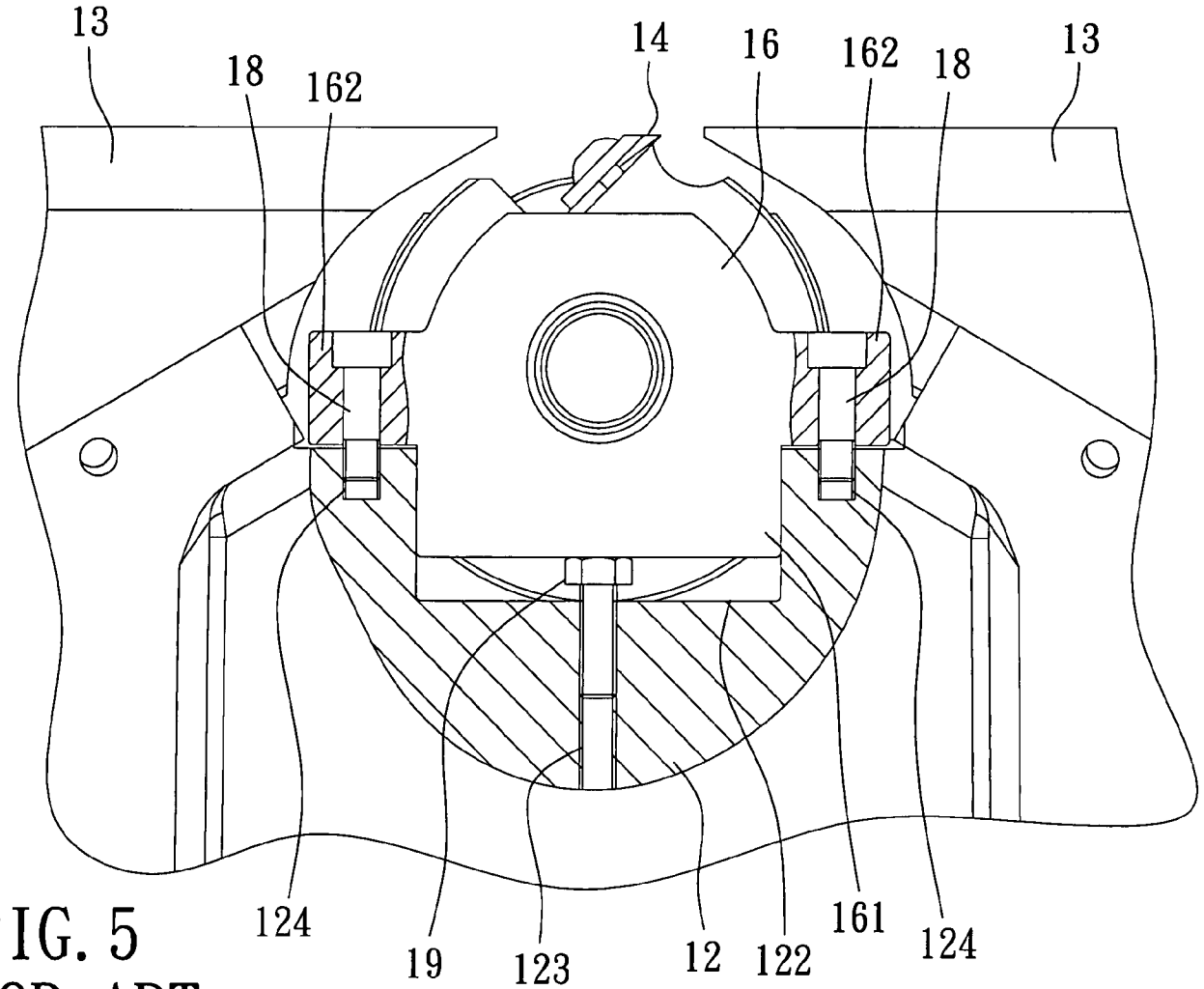
FIG. 5 PRIOR ART
FIG. 5 is a fragmentary and partly sectional view of the conventional hand-feed jointer/planer machine after level adjustment.
Figure 6:
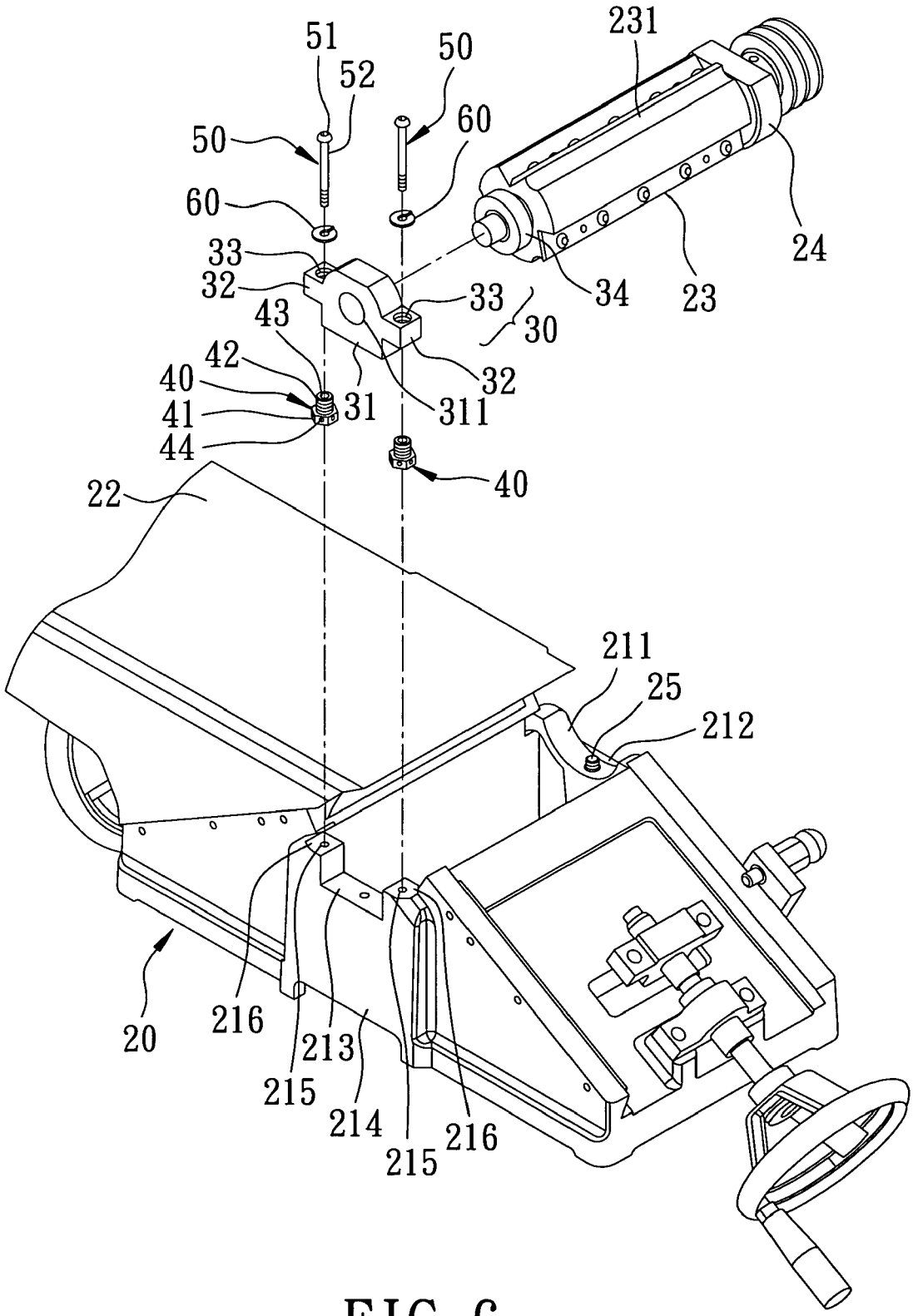
FIG. 6 is a fragmentary exploded perspective view of the preferred embodiment of a level adjusting device according to this invention when incorporated in a hand-feed jointer/planer machine.
Figure 7:
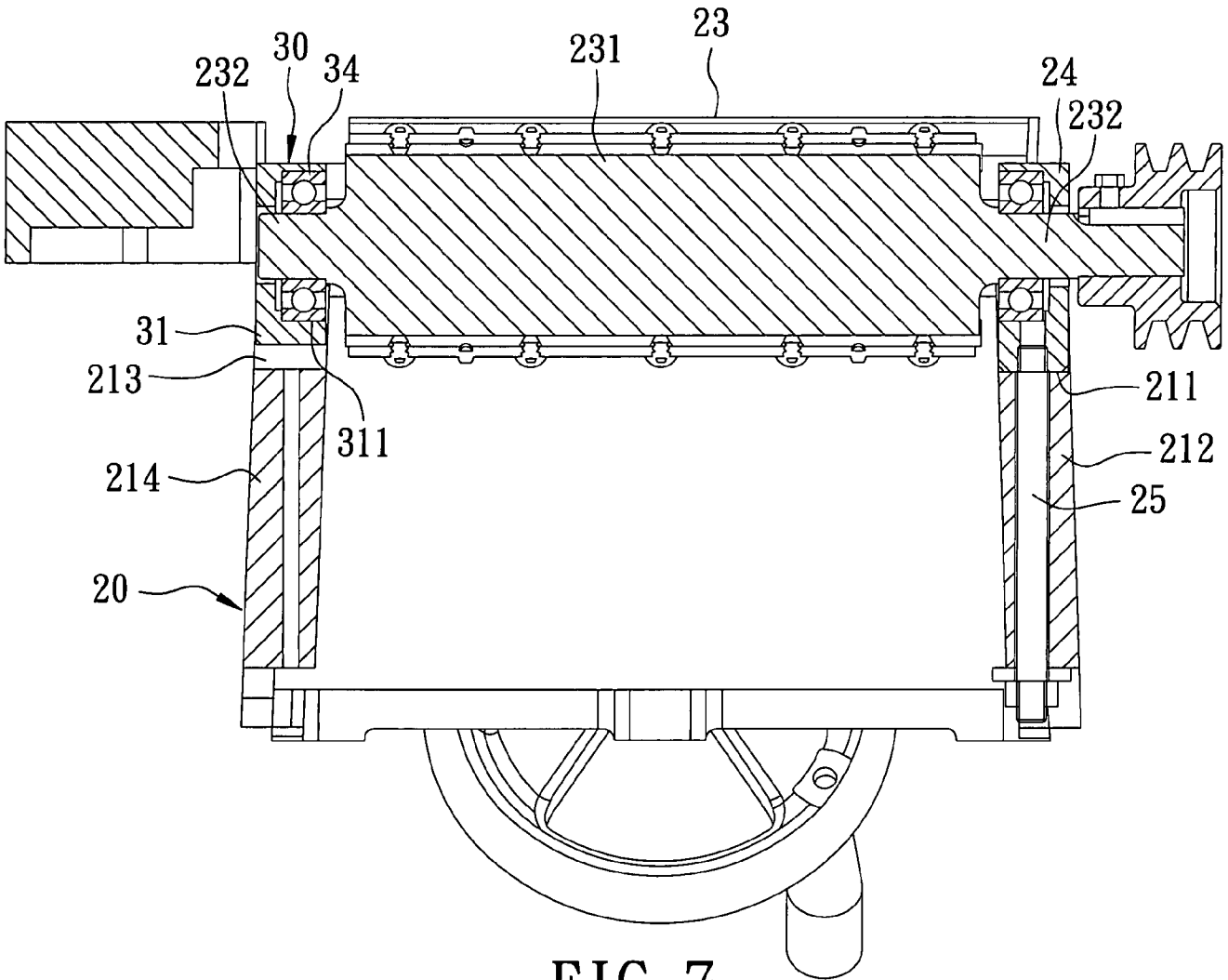
FIG. 7 is a partly sectional view of the preferred embodiment when incorporated in the hand-feed jointer/planer machine.
Figure 8:
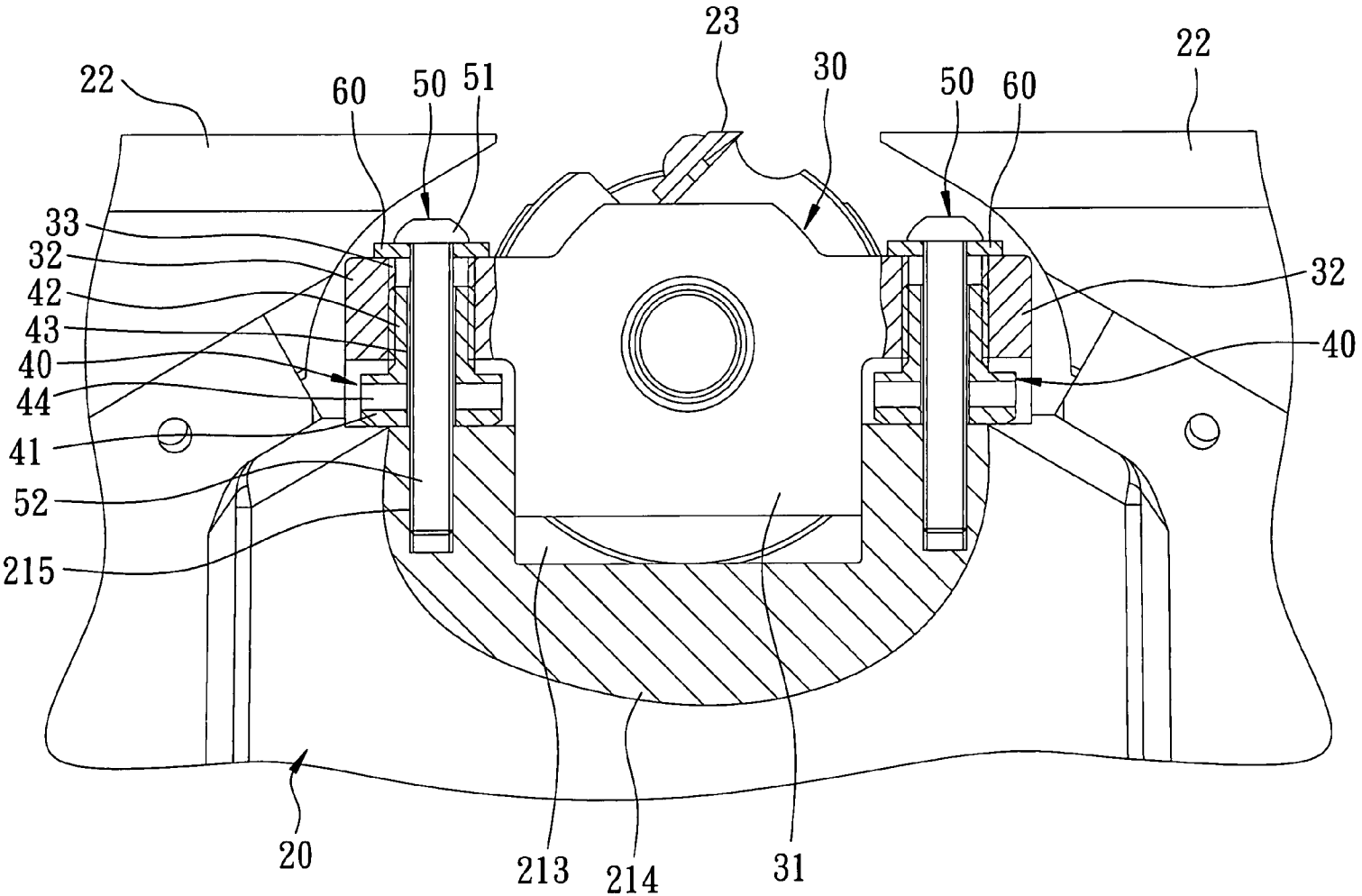
FIG. 8 is a fragmentary and partly sectional view of the preferred embodiment when incorporated in the hand-feed jointer/planer machine during a level adjusting process.

Referring to FIGS. 6 to 8, the preferred embodiment of a level adjusting device according to the present invention is employed in a hand-feed jointer/planer machine 20 for adjusting a level of a cutter head 23. The jointer/planer machine 20 includes infeed and outfeed tables 22 opposite to each other in a longitudinal direction. The cutter head 23 includes a knives-mounting body 231 which is elongated along a rotating axis that is transverse to the longitudinal direction, and which has front and rear journal segments 232 extending respectively from two opposite sides of the knives-mounting body 231 along the rotating axis.

The level adjusting device according to this invention is shown to comprise front and rear support frames 212, 214, front and rear anti-friction bearing units 24,30, left and right adjusting screws 40, and left and right tightening screws 50.

The front support frame 212 is adapted to be interposed between the infeed and outfeed tables 22, and has a front seat wall 211 facing upwardly.

The rear support frame 214 is adapted to be interposed between the infeed and outfeed tables 22, and is spaced apart from the front support frame 212 along the rotating axis. The rear support frame 214 includes left and right base abutments 216 which face upwardly and which are spaced apart from each other in the longitudinal direction, and two screw holes 215 which extend respectively from the left and right base abutments 216 along a revolving axis in an upright direction that is transverse to both the longitudinal direction and the rotating axis.

The front anti-friction bearing unit 24 is adapted to journal the front journal segment 232, and has a profile configured to be mated with the front seat wall 211 so as to rest thereon and to hold the front journal segment 232 at a predetermined height. Thus, the front anti-friction bearing unit 24 is guarded against angular shifting movement about the rotating axis relative to the front seat wall 211. In addition, the front anti-friction bearing unit 24 is secured to the front seat wall 211 by means of a setscrew 25.

The rear anti-friction bearing unit 30 includes a rear anti-friction bearing member 34 adapted to journal the rear journal segment 232, a height-adjustable carrier 31 having an insertion bore 311 which defines a centerline and which is configured to permit the rear anti-friction bearing member 34 to be fitted therein to thereby bring the rotating axis in line with the centerline, and left and right lugs 32 which are disposed respectively outboard of the height-adjustable carrier 31 and opposite to each other in the longitudinal direction. Each of the left and right lugs 32 has an inner tubular threaded surface 33 extending in the upright direction.

Each of the left and right adjusting screws 40 has a threaded segment 42 which is threadedly engaged with the inner tubular threaded surface 33 of a respective one of the left and right lugs 32, an enlarged abutting end 41 which is opposite to the threaded segment 42, and a passage hole 43 which extends through the threaded segment 42 and the abutting end 41 along the revolving axis. Preferably, each of the left and right adjusting screws 40 has a plurality of insertion holes 44 which are disposed between the threaded segment 42 and the abutting end 41, which extend radially, and which are angularly spaced apart from one another about the revolving axis.

Each of the left and right tightening screws 50 includes a threaded bolt 52 which is disposed to pass through the passage hole 43 in the respective adjusting screw 40 and to threadedly engage the respective screw hole 215, an enlarged head 51 which is disposed opposite to the threaded bolt 52, and an elastomeric washer 60 which is interposed between the enlarged head 51 and the respective lug 32 when the threaded bolt 52 is threadedly engaged with the respective screw hole 215 so as to tighten the respective lug 32 onto the respective base abutment 216.

In assembly, the threaded segments 42 are respectively and threadedly engaged with the inner tubular threaded surfaces 33 from lower surfaces of the lugs 32. Subsequently, the front anti-friction bearing unit 24 is rested on the front seat wall 211, and the carrier 31 is rested on a recess portion 213 of the rear support frame 214 with the abutting ends 41 in frictional engagement with the left and right base abutments 216, respectively. Thereafter, the setscrew 25 is used to tighten the front anti-friction bearing unit 24 onto the front seat wall 211 so as to place the front anti-friction bearing unit 24 at a predetermined height. The threaded bolts 52 of the tightening screws 50 are inserted respectively into the passage holes 43 from upper ends of the adjusting screws 40 and are engaged with the screw holes 215 threadedly and respectively so as to secure the front and rear anti-friction bearing units 24,30 and the cutter head 23 for performing a planing operation.

Figure 9:
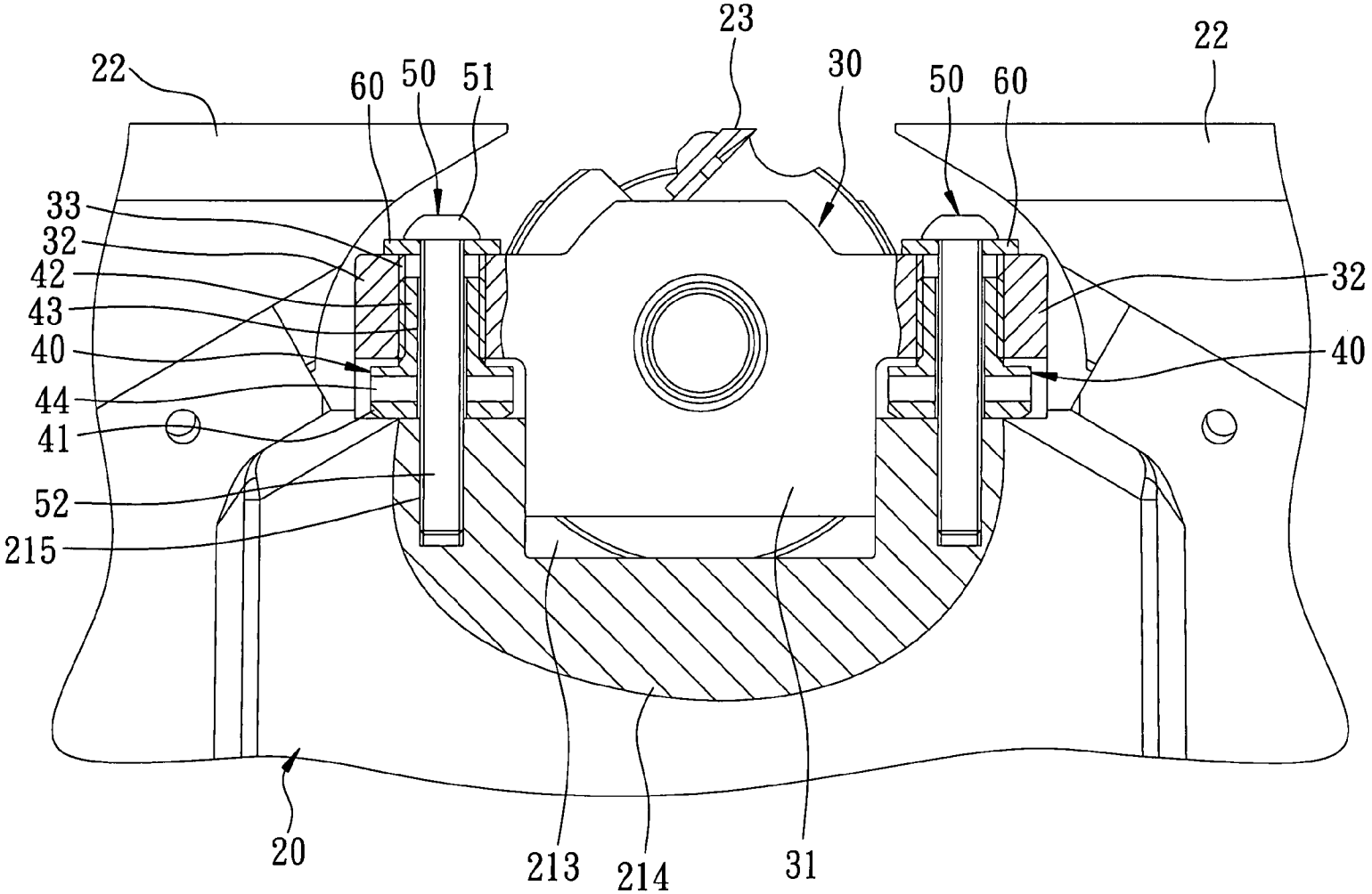
FIG. 9 is a fragmentary and partly sectional view of the preferred embodiment when incorporated in the hand-feed jointer/planer machine after level adjustment.

Referring to FIGS. 6, 8 and 9, when it is desired to adjust the level of the cutter head 23, a lever (not shown) is utilized to be sleeved on the respective adjusting screw 40, or to be inserted into one of the insertion holes 44 to turn the adjusting screw 40 about the revolving axis. By virtue of the threaded engagement between the threaded segment 42 and the inner tubular threaded surface 33, the respective lug 32 is guided by the respective tightening screw 50 to move relative to the adjusting screw 40 so as to raise or lower the centerline of the carrier 31 based on the predetermined height, thereby enabling level adjustment of the knives-mounting body 231.

It is noted that the abutting end 41 can be kept in frictional engagement with the respective base abutment 216 during the process of turning. Moreover, the rear anti-friction bearing unit 30 can be firmly retained by the rear support frame 214, and the adjusting operation is steady and quick.

As illustrated, the carrier 31 is raised and lowered synchronously with turning of the adjusting screws 40 so that the level adjustment of the cutter head 23 is convenient and easy.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A level adjusting device for a cutter head of a jointer/planer machine which includes infeed and outfeed tables opposite to each other in a longitudinal direction, the cutter head including a knives-mounting body which is elongated along a rotating axis that is transverse to the longitudinal direction, and which has front and rear journal segments extending respectively from two opposite sides of the knives-mounting body along the rotating axis, said level adjusting device comprising:

a front support frame which is adapted to be interposed between said infeed and outfeed tables, and which has a front seat wall facing upwardly;

a rear support frame which is adapted to be interposed between said infeed and outfeed tables, and which is spaced apart from said front support frame along the rotating axis, said rear support frame including left and right base abutments which face upwardly, and which are spaced apart from each other in the longitudinal direction;

a front anti-friction bearing unit which is adapted to journal said front journal segment, and which is disposed to rest on said front seat wall so as to hold the front journal segment at a predetermined height;

a rear anti-friction bearing member adapted to journal said rear journal segment;

a height-adjustable carrier having an insertion bore which defines a centerline and which is configured to permit said rear anti-friction bearing member to be fitted therein to thereby bring the rotating axis in line with the centerline;

left and right lugs which are disposed respectively outboard of said height-adjustable carrier and opposite to each other in the longitudinal direction, each of said left and right lugs having an inner tubular threaded surface extending in an upright direction that is transverse to both the longitudinal direction and the rotating axis; and left and right adjusting screws, each having a threaded segment which is threadedly engaged with said inner tubular threaded surface of a respective one of said left and right lugs, and an abutting end which is opposite to said threaded segment, and which is configured to be turnable about a revolving axis in the upright direction, said abutting end being kept in frictional engagement with a respective one of said left and right base abutments during turning of said abutting end such that, by virtue of the turning of said abutting end, the respective one of said left and right lugs is moved relative to a respective one of said left and right adjusting screws so as to raise or lower the centerline of said height-adjustable carrier based on the predetermined height, thereby enabling level adjustment of the knives-mounting body.

2. The level adjusting device as claimed in claim 1, wherein said rear support frame has two screw holes which respectively extend from said left and right base abutments along the revolving axis;

each of said left and right adjusting screws having a passage hole which extends through said threaded segment and said abutting end along the revolving axis, said level adjusting device further comprising:

left and right tightening screws, each including a threaded bolt which is disposed to pass through said passage hole and to threadedly engage a respective one of said screw holes so as to guide movement of the respective one of said left and right lugs.

3. The level adjusting device as claimed in claim 2, wherein each of said left and right tightening screws includes an enlarged head which is disposed opposite to said threaded bolt, and an elastomeric washer which is interposed between said enlarged head and the respective one of said left and right lugs when said threaded bolt is threadedly engaged with the respective one of said screw holes so as to tighten the respective one of said left and right lug onto the respective one of said left and right base abutments.

4. The level adjusting device as claimed in claim 2, wherein each of said left and right adjusting screws has a plurality of insertion holes which are disposed between said threaded segment and said abutting end, which extend radially, and which are angularly spaced apart from one another about the revolving axis, each of said insertion holes being adapted for receiving a lever to facilitate turning of said abutting end about the revolving axis.

5. The level adjusting device as claimed in claim 1, wherein said front anti-friction bearing unit has a profile configured to be mated with said front seat wall such that said front anti-friction bearing unit is guarded against angular shifting movement about the rotating axis relative to said front seat wall.

* * * * *